US010422215B2

(12) United States Patent
Porter

(10) Patent No.: US 10,422,215 B2
(45) Date of Patent: Sep. 24, 2019

(54) COMPLETION TOOL LOCATING ARRANGEMENT AND METHOD OF POSITIONING A TOOL WITHIN A COMPLETION STRUCTURE

(71) Applicant: Robert A. Porter, Okotoks (CA)

(72) Inventor: Robert A. Porter, Okotoks (CA)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 213 days.

(21) Appl. No.: 14/273,042

(22) Filed: May 8, 2014

(65) Prior Publication Data

US 2015/0322751 A1 Nov. 12, 2015

(51) Int. Cl.

| | |
|---|---|
| ***E21B 47/10*** | (2012.01) |
| ***E21B 43/12*** | (2006.01) |
| ***E21B 43/25*** | (2006.01) |
| ***E21B 23/01*** | (2006.01) |
| ***E21B 34/00*** | (2006.01) |

(52) U.S. Cl.

CPC ..... *E21B 47/1015* (2013.01); *E21B 23/01* (2013.01); *E21B 43/12* (2013.01); *E21B 43/25* (2013.01)

(58) Field of Classification Search

CPC ..... E21B 43/12; E21B 43/25; E21B 34/00; E21B 23/01; E21B 47/1015

See application file for complete search history.

(56) References Cited

U.S. PATENT DOCUMENTS

| | | | | |
|---|---|---|---|---|
| 4,583,593 | A * | 4/1986 | Zunkel | E21B 23/04 166/131 |
| 5,379,835 | A | 1/1995 | Streich | |
| 7,909,118 | B2 * | 3/2011 | Sanfelice | E21B 7/061 166/117.6 |
| 8,985,228 | B2 | 3/2015 | Xu et al. | |
| 9,175,535 | B2 * | 11/2015 | Gregory | E21B 4/02 |
| 2004/0084186 | A1 * | 5/2004 | Allison | E21B 27/02 166/305.1 |
| 2012/0125635 | A1 | 5/2012 | Watson et al. | |
| 2012/0217025 | A1 * | 8/2012 | Shkurti | E21B 33/1216 166/387 |
| 2012/0234546 | A1 | 9/2012 | Xu | |
| 2013/0112400 | A1 * | 5/2013 | Woiceshyn | B01D 29/111 166/227 |

(Continued)

FOREIGN PATENT DOCUMENTS

| | | | | |
|---|---|---|---|---|
| WO | WO 0181914 | A1 * | 11/2001 | E21B 47/1015 |

OTHER PUBLICATIONS

Definition of "tracer" accessed on Feb. 26, 2017 via www.thefreedictionary.com/tracer.*

(Continued)

*Primary Examiner* — David J Bagnell
*Assistant Examiner* — Manuel C Portocarrero
(74) *Attorney, Agent, or Firm* — Cantor Colburn LLP

(57) ABSTRACT

A completion tool locating arrangement includes, an anchor attachable within a completion structure having a bore extending through the anchor, a seat disposed at the anchor receptive to a plug runnable thereagainst, and an attachment feature positioned at the anchor. The attachment feature is configured to allow at least one tool to be attached thereto for positioning the at least one tool with the anchor within the completion structure.

23 Claims, 2 Drawing Sheets

(56) References Cited

U.S. PATENT DOCUMENTS

| | | | | |
|---|---|---|---|---|
| 2013/0206409 | A1 | 8/2013 | Stone et al. | |
| 2013/0213654 | A1 | 8/2013 | Dewey et al. | |
| 2013/0248172 | A1* | 9/2013 | Angeles Boza ..... | E21B 43/08 166/250.01 |

OTHER PUBLICATIONS

Definition of "screw" accessed on Feb. 26, 2017 via www.thefreedictionary.com/screw.*

Notification of Transmittal of the International Search Report and the Written Opinion of the International Searching Authority; PCT/US2015/022427; dated Jun. 30, 2015; Korean Intellectual Property Office; 13 pages.

Williams, Brock et al., "Intelligent Inflow Tracers Obtain Information With Less Risk, Cost"; Young Technology Showcase; JPT, Sep. 2013; pp. 50-55.

* cited by examiner

COMPLETION TOOL LOCATING ARRANGEMENT AND METHOD OF POSITIONING A TOOL WITHIN A COMPLETION STRUCTURE

BACKGROUND

Completions in the oil and gas recovery industries typically employ include a lined or cased and cemented borehole with production inlet flow areas in the producing zones. To maximize production rates anything positioned within the liner or casing is usually drilled or milled out. However, it may be desirable for certain tools to be positioned within the liner or casing that remain there during production and possible for the life of the well. Tools and methods for deploying such tools that still allow production of the well are of interest to those who practice in the art.

BRIEF DESCRIPTION

Disclosed herein is a completion tool locating arrangement. The arrangement includes, an anchor attachable within a completion structure having a bore extending through the anchor, a seat disposed at the anchor receptive to a plug runnable thereagainst, and an attachment feature positioned at the anchor configured to allow at least one tool to be attached thereto for positioning the at least one tool with the anchor within the completion structure.

Further disclosed herein is a method of positioning a tool within a completion structure. The method includes, attaching the tool to an anchor, positioning the anchor and the tool within the completion structure, setting the anchor, and fixing the anchor and the tool to the completion structure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
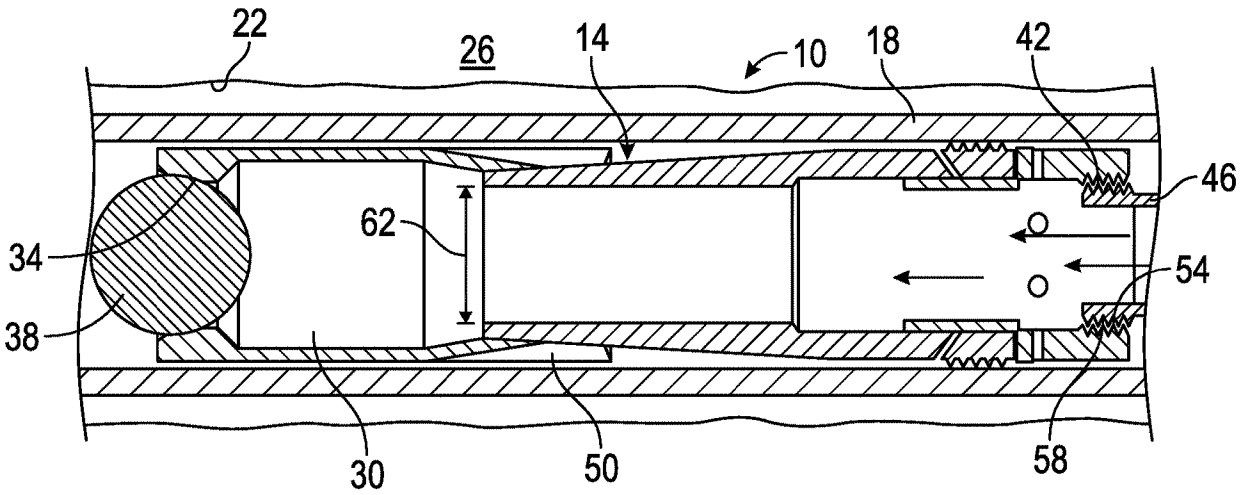
FIG. 1A depicts a cross sectional view of a portion of a completion tool locating arrangement disclosed herein.
Figure 1B:
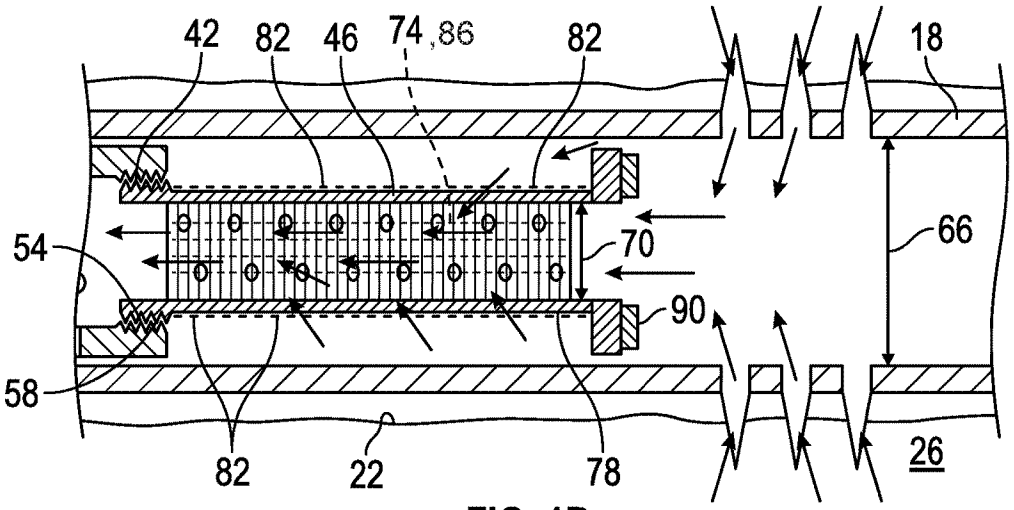
FIG. 1B depicts a cross sectional view of an additional portion of the completion tool locating arrangement of FIG. 1A.

Referring to FIGS. 1A and 1B an embodiment of a completion tool locating arrangement disclosed herein is illustrated at 10. The completion tool locating arrangement 10 includes an anchor 14 attachable within a completion structure 18, shown herein as a liner or casing within a borehole 22 in an earth formation 26. The anchor 14 has a bore 30 that extends longitudinally therethrough, and a seat 34 receptive to a plug 38, such as a ball, for example. When one of the plugs 38 is seated at the seat 34 it occludes fluid flow through the bore 30 in a downstream direction from the seat 34. The anchor 14 includes an attachment feature 42, illustrated in one embodiment as threads, that allows a tool 46 to be fixedly attached to the anchor 14. An optional seal

50 can be sealably engaged to both the anchor 14 and the completion structure 18 when the anchor 14 is set so that pressure built in fluid upstream of one of the plugs 38 seated at the seat 34 cannot allow fluid to flow around the plug 38 and between the anchor 14 and the completion structure 18 and past the seal 50.

The foregoing structure allows the tool 46 to be positioned at a selected location within the completion structure 18. Doing so requires attaching the tool 46 to the anchor 14, positioning the anchor 14 and the tool 46 within the completion structure 18 at the selected location. Then setting the anchor 14 thereby fixing the anchor 14 and the tool 46 to the completion structure 18.

As mentioned above the attachment feature 42 in an illustrated embodiment is threads 54 on the anchor 14 that are threadably engagable with threads 58 of the tool 46. This threadable engagement may form a seal between the anchor 14 and the tool 46. Alternate embodiments of the attachment feature 42 that include such things as collets, and bayonet type locking features to allow the structural attachment of the tool 46 to the anchor 14 are also contemplated. However alternate embodiments are not limited to these features.

The tool 46 may be any device that may be desirable to locate within the completion structure 18, such as, a tracer sub, a valve, or a device to occlude, to monitor or to confirm flow therepast through the completion structure 18, for example. The anchor 14 and the tool 46 of an embodiment illustrated herein are configured to remain in the completion structure 18 for the life of the completion structure 18. As such their components are made of materials that hold up well in high temperatures and high pressures and caustic fluids as are typically found in downhole environments. These materials include metals and ceramics, for example, but are not limited to these. The anchor 14 can serve as a treating plug or fracturing plug, for example, by allowing pressure to be built when one of the plugs 38 is sealed against the seat 34.

Since the anchor 14 is configured to remain in the completion structure 18 during production of hydrocarbons, for example, from the earth formation 26, a minimum inner radial dimension 62 of the bore 30 is large in comparison to an inner radial dimension 66 of the completion structure 18, so as to minimize restriction to production flow through the bore 30. In fact, the anchor 14 is configured so that the minimum inner radial dimension 62 is in the range of about 80% to 85% of the inner radial dimension 66. The large bore 30 size, in addition to creating very low restriction to flow can allow interventions to take place therethrough. As such, the tool 46 in one embodiment is configured to have a minimum inner radial dimension 70 that is no smaller than the minimum inner radial dimension 62.

The tool 46 illustrated in an embodiment herein includes tracer elements 74. The tracer elements 74 are configured to release a chemical when exposed to a selected fluid.For example, one of the tracer elements 74 may only release a chemical when exposed to water, while another of the tracer elements 74 may only release a chemical when exposed to oil. The tracer elements 74 can also be configured so that each of the tracer elements 74 employed can release a different chemical. A plurality of the completion tool locating arrangements 10 can be deployed within a single one of the completion structures 18, for example, (see FIG. 2) with each location including one of the tracer elements 74 that release chemical when exposed to water and another of the tracer elements 74 that releases chemical when exposed to oil. Such a system allows an operator to determine where water and oil are being produced along the completion structure 18. Concentrations of the chemicals in the total fluids produced can also be used to determine what percent of the total water produced and what percent of the total oil produced came from each location along the completion structure 18.

One embodiment of the tool 46 that includes the tracer elements 74 includes a perforated pipe 78 with wire 82 wound therearound. This configuration may be similar in structure to a sand screen. The tracer elements 74 can be in the shape of long strips 86 that are positioned between the wound wire 82 and the perforated pipe 78 to maintain the position of the tracer elements 74 and assure exposure thereof to fluids flowing therepast. An end 90 of the perforated pipe 78 can be sealably engaged with the completion structure 18 or intentionally left unsealed (as illustrated herein) to allow fluid to flow both through the minimum inner radial dimension 70 as well as through an annular space defined between the perforated pipe 78 and the completion structure 18.

Figure 2:
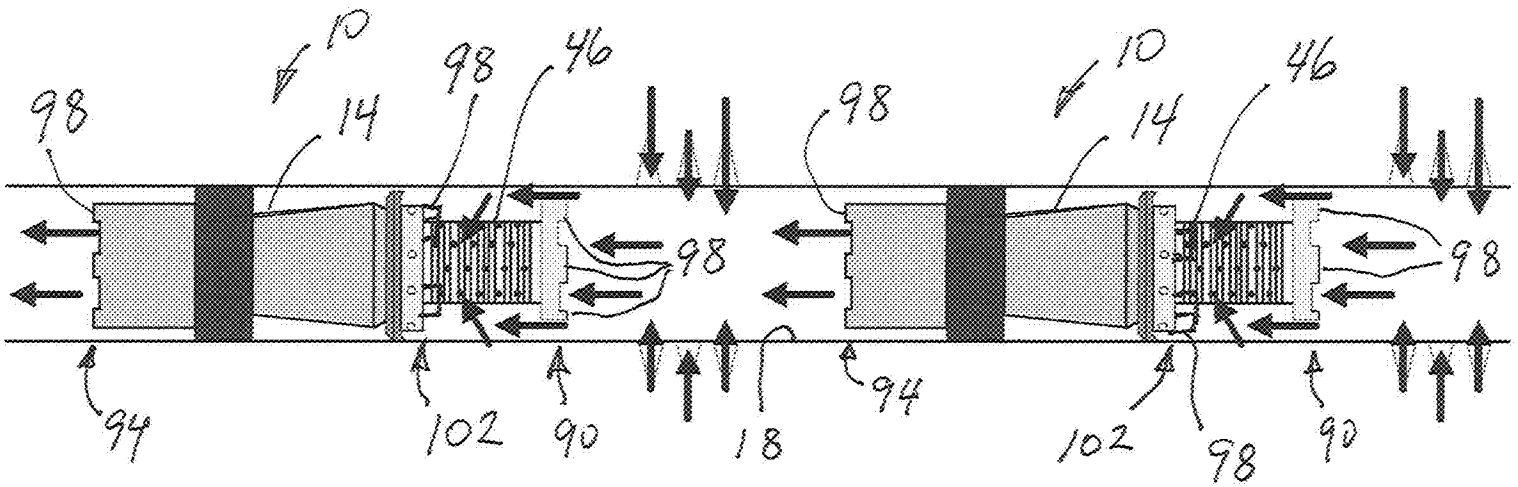
FIG. 2 depicts a side view of two of the completion tool locating arrangements of FIG. 1 located within a completion structure with each having a tool attached thereto.

Referring to FIG. 2, in one embodiment disclosed herein a first end 94 of the anchor 14 has castellations 98 that are engagable with castellations 98 on a second end 102 of another of the anchors 14. This is in situations wherein one of the tools 46 is not attached to the second end 102 of the anchor 14 thereby leaving the castellations 98 on the second end 102 available for engagement with castellations 98 on the first end 94 of an adjacent anchor 14. In situations wherein one of the tool 46 is attached to the second end 102 of the anchor 14 castellations 98 on the end 90 of the tool 46 are engagable with castellations 98 on the first end 94 of an adjacent anchor 14. The rotational locking created by the engagement of the castellations 98 is useful in preventing rotation of the anchor 14 and/or the tool 46 when trying to drill one of the foregoing out of the completion structure 18.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A completion tool locating arrangement comprising:

a tool having a perforated pipe and screen and configurable for dispersal of a tracer;

an anchor having an uphole end and a downhole end, the anchor attachable within a completion structure, the anchor having a bore extending through the anchor from the uphole end to the downhole end, and the anchor is one of a fracturing plug and a treating plug;

a seat disposed at the uphole end of the anchor receptive to a plug runnable there against to occlude fluid flow through the bore in a downstream direction from the seat towards the downhole end; and an attachment feature positioned adjacent the downhole end of the anchor and configured to allow the tool to be attached thereto for positioning the tool with the anchor within the completion structure.

2. The completion tool locating arrangement of claim 1, wherein the anchor includes a seal that is sealingly engageable to the completion structure and the anchor.

3. The completion tool locating arrangement of claim 1, wherein the attachment feature includes threads.

4. The completion tool locating arrangement of claim 1, wherein the attachment feature includes a collet.

5. The completion tool locating arrangement of claim 1, wherein the attachment feature includes bayonet type locking features.

6. The completion tool locating arrangement of claim 1, further comprising the tracer, wherein the tracer is positioned between the perforated pipe and the screen.

7. The completion tool locating arrangement of claim 6, wherein the tracer is in a shape of a strip maintained between the perforated pipe and the screen.

8. The completion tool locating arrangement of claim 6, wherein the tracer is configured to release a chemical into production fluids when exposed to water or oil.

9. The completion tool locating arrangement of claim 1, wherein the anchor and the tool are configured to last the life of the completion structure.

10. The completion tool locating arrangement of claim 1, wherein the anchor is the fracturing plug.

11. The completion tool locating arrangement of claim 1 wherein the tool has an uphole end and a downhole end, the uphole end of the tool attached to the downhole end of the anchor; and further comprising:

first castellations positioned at the downhole end of the anchor and second castellations positioned at the uphole end of the tool, the first and second castellations configured to allow the tool to be attached to the anchor for positioning the tool with the anchor within the completion structure, and rotationally lock the tool to the anchor.

12. The completion tool locating arrangement of claim 11, wherein the tool further includes a tracer maintained between the perforated pipe and the screen, the tracer configured to release a chemical into production fluids when exposed to water or oil.

13. The completion tool locating arrangement of claim 1, wherein a minimum radial dimension of the bore is in a range of about 80 to 85 percent of an inner radial dimension of the completion structure where the anchor is attached.

14. The completion tool locating arrangement of claim 1, wherein the anchor is the treating plug.

15. A method of treating a formation with the completion tool locating arrangement of claim 1, comprising:

plugging the anchor with a plug run against the seat; and treating the formation.

16. The method of claim 15, further comprising fracturing the formation.

17. The completion tool locating arrangement of claim 1, wherein the tool has an uphole end and a downhole end, the uphole end of the tool attached to the downhole end of the anchor; and further comprising:

castellations positioned at the uphole end of the anchor and castellations positioned at the downhole end of the tool, the castellations on the uphole end of the anchor and downhole end of the tool configured to allow the tool and anchor to engage with castellations on adjacent tools and anchors within the completion structure.

18. The completion tool locating arrangement of claim 17, further comprising castellations positioned at the downhole end of the anchor and castellations positioned at the uphole end of the tool, the castellations at the downhole end of the anchor engaged with the castellations at the uphole end of the tool.

19. A method of positioning a tool within a completion structure comprising:

attaching the tool having a perforated pipe and screen and configurable to allow for dispersal of a tracer to an anchor, the anchor being one of a fracturing plug and a treating plug, the anchor having an uphole end and a downhole end, the anchor having a bore extending through the anchor from the uphole end to the downhole end, a seat disposed at the uphole end of the anchor receptive to a plug runnable there against to occlude fluid flow through the bore in a downstream direction from the seat towards the downhole end, an attachment feature positioned adjacent the downhole end of the anchor, and the tool attached to the anchor at the attachment feature;

positioning the anchor and the tool within the completion structure;

setting the anchor; and fixing the anchor and the tool to the completion structure.

20. The method of positioning a tool within a completion structure of claim 19, further comprising sealing the anchor to the completion structure.

21. The method of positioning a tool within a completion structure of claim 19, further comprising threadably attaching the tool to the anchor.

22. The method of positioning a tool within a completion structure of claim 19, further comprising attaching the tool to the anchor with a bayonet locking feature.

23. The method of positioning a tool within a completion structure of claim 19, further comprising attaching the tool to the anchor with a collet.

* * * * *